US005775527A

United States Patent [19]

Bösl et al.

[11] Patent Number: 5,775,527

[45] Date of Patent: Jul. 7, 1998

[54] CLOSURE CAP WITH ANTI-TAMPER STRIP

[75] Inventors: Udo Bösl, Eimeldingen; Michael Kirchgessner, Egringen, both of Germany

[73] Assignee: Crown Cork AG, Reinach, Switzerland

[21] Appl. No.: 582,366

[22] Filed: Jan. 5, 1996

[30] Foreign Application Priority Data

Feb. 10, 1995 [CH] Switzerland ..... 395/95

[51] Int. Cl.[6] ..... B65D 41/34

[52] U.S. Cl. ..... 215/252

[58] Field of Search ..... 215/252

[56] References Cited

U.S. PATENT DOCUMENTS

| | | | |
|---|---|---|---|
| 4,511,053 | 4/1985 | Brandes et al. | 215/252 |
| 4,694,969 | 9/1987 | Granat | 215/252 |
| 4,801,030 | 1/1989 | Barriac | 215/252 |
| 4,801,031 | 1/1989 | Barriac | 215/252 |
| 5,107,998 | 4/1992 | Zumbuhl | 215/252 |
| 5,131,550 | 7/1992 | Thompson | 215/252 |
| 5,400,913 | 3/1995 | Kelly | 215/252 |

FOREIGN PATENT DOCUMENTS

| | | |
|---|---|---|
| 0 390 412 A1 | 10/1990 | European Pat. Off. . |
| 0 635 434 A1 | 1/1995 | European Pat. Off. . |
| WO 94/14673 | 7/1994 | WIPO . |

*Primary Examiner*—Stephen Cronin

*Attorney, Agent, or Firm*—Woodcock Washburn Kurtz Mackiewicz & Norris LLP

[57] ABSTRACT

A closure cap with a tearable anti-tamper strip (3) have flaps (5) which extend radially inwards from the inside surface of the anti-tamper strip towards the cap base. With the closure cap in position on the container mouth, these flaps (5) engage beneath a circumferential bead (6) on the container mouth. In order to enhance the stability and resistance to bending of the flaps, their lateral edge areas (7) are directed inwards in such a way that, at least one position, they possess a lesser distance in relation to the cap axis than the flap centres (8). The facing surface (11) of the flaps (5) is directed towards the cap base (1) and is inclined towards the cap axis so that, on opening of the closure, the effective force (F) impinges on the centre of the flap relatively far out. The centre of the flaps (8) is here preferaly designed to be thicker than its lateral edge area (7).

8 Claims, 3 Drawing Sheets

CLOSURE CAP WITH ANTI-TAMPER STRIP

FIELD OF THE INVENTION

The invention is generally directed to a closure cap with a tearable anti-tamper strip. With such closure caps, the condition of the anti-tamper strip permits recognition of prior opening of the container. With the closure cap in position on the container mouth, the anti-tamper strip will engage beneath a bead on the container mouth so that when the container is opened for the first time, the anti-tamper strip will at least partially tear away.

BACKGROUND OF THE INVENTION

Anti-tamper strips are particularly frequently used with screw closures, in particular with screw caps for the closure of beverage containers. However, other types of closure cap, such as snap closures, can also be provided with tearable anti-tamper strips.

For the closure of disposable containers, as a rule closure caps are used with an annular circumferential anti-tamper strip that remains on the container neck when the container is opened for the first time. Conversely, the anti-tamper strip for the closure of recyclable containers is preferably connected with the cap wall in such a way that, on opening of the container, it will only partially tear and will thus continue to be connected with the cap wall. With this embodiment, a shorter anti-tamper strip extending only over a portion of the cap wall circumference is also frequently used.

The tearable connection between anti-tamper strip and cap wall can be designed in many different ways that are widely documented in the relevant patent literature. With closure caps that are manufactured in one piece from plastic, the anti-tamper strip is particularly frequently connected by tearable connecting bridge pieces with the lower edge of the cap wall.

On the inside surface of the anti-tamper strip, engagement means are arranged which, with the closure cap in position on the container, engage beneath a bead on the container mouth. To this end, engagement elements are frequently used that are rigidly connected with the anti-tamper strip. When fitting the closure cap, these engagement elements are pressed radially outwards on being pushed over the bead on the container mouth. Since the engagement elements are rigidly connected with the anti-tamper strip, this will simultaneously lead to deformation of the anti-tamper strip and thus to a load on the tearable connection between anti-tamper strip and cap wall. In the case of screw closures, this loading will be additionally increased by forces imparted between the cap wall and the anti-tamper ring, the anti-tamper ring being subjected to braking action by the engagement means making contact with the bead on the container mouth. In EP-A2 117 104, the use of radially inwardly protruding flaps on the inside of the anti-tamper strip has thus already been suggested as an engagement means, said flaps pointing upwards towards the cap base when the closure cap is in position on the container mouth and engaging beneath the bead on the container mouth. These flaps are connected with the anti-tamper strip solely at one end and their free end is able to pivot in the radial direction relative to the anti-tamper strip. These flaps can therefore be pivoted outwards in the radial direction when they slide over the bead on the container mouth on initial fitting of the closure cap. The resultant loads of the anti-tamper strip and its tearable connection with the cap wall will thus be considerably reduced.

A problem with state of the art flaps is their inadequate firmness, in particular the inadequate resistance to pressure in the longitudinal direction of the flaps. This load occurs on opening of the closure cap, or with any attempt to pull the anti-tamper over the bead without tearing it. The state of the art flaps become bent in the longitudinal direction in this case, leading to a reduced blocking effect being imparted by the flaps. In extreme cases, this can lead to the flaps leaving their locking position against the bead of the container mouth to assume a position pointing downwards, away from the cap base. It is therefore a purpose of the invention to further improve the resistance to loading of state of the art flaps. According to the invention, this purpose is fulfilled by a closure cap possessing the features of claim 1.

SUMMARY OF THE INVENTION

To this end, the lateral edge areas of the flaps directed towards the cap are pointed inwards in such a way that, at least at one position, they possess a lesser distance in relation to the cap axis than the centre of the flaps. To this end, the surfaces directed towards the cap axis of the flaps directed towards the cap base must possess a curve at at least one position, the radius of said curve being less than the distance between the flap and the axis of the cap. Preferably, the flaps are shaped symmetrically in relation to their centres, especially good results being attained with flaps folded symetrically in relation to their centres. The aforementioned curve is also located in the area of the flap centre.

By means of the curve of the flaps, their resistance to loading will be considerably enhanced. The bending of the flaps arising with longitudinal loading and in particular during opening of the closure cap will be greatly reduced by their curved form. The stability of the flaps can be further improved if the flap centre is thicker than their lateral side areas. The greatest portion of the forces imparted onto a flap can be transmitted via the thicker flap centre. Since the flap centre is at a greater distance from the cap axis than its lateral edge area of the flap, this will have the additional advantage that the point of impingement of the main force will be displaced radially outwards into the region of the anti-tamper strip. The bending load of the flaps will as a result be further reduced.

The flaps are preferably designed in such a way that their facing surface directed towards the bead on the container mouth is inclined towards the cap axis. A position for the radially further inward area of this facing surface vertically lower and thus further away from the cap base than the area of the facing surface lying radially further outwards will thus be achieved. With the closure cap in position on the container mouth, the radially outer area of the flap will thus make contact with the bead on the container mouth, whereas the radially further inward and lower portion of the flap will make contact with the container neck beneath the bead. The curved inner surface will here make contact on the outer surface of the container neck at two points, to the left and to the right of the flap centre. Preferably, the facing surfaces of the flaps are more heavily inclined towards the cap axis than a normal plane running vertically to the neutral mean centre-line of each respective flap.

With one of the preferred embodiments, each of the flaps comprises a left and right flap half that meet in the centre of the flap at an angle. With that, a flap is concerned that is folded symmetrically towards its centre. The angle at which both the flap halves meet at the centre amounts preferably to 120°, but also if this angle is only slightly less than the 180° limit, there will always be a position left and right of the flap centre at which the distance to the cap axis is less than in the area of the flap centre itself.

The flap halves of the flaps directed towards the cap base each have an inner demarcation surface directed towards the cap axis and an outer demarcation surface directed towards the anti-tamper strip. Preferably, the flap halves are so designed that their inner and outer demarcation surfaces diverge in relation to the centre of the flap at an angle of between 5° and 30°. A flap centre that is thicker than the lateral edge areas of the flap will thus be attained. By this means, the spring effect of the flaps in the radial direction will be additionally enhanced: if the flaps are pushed over the bead on the container mouth on fitting of the closure cap, first of all their thinner lateral edge areas will make contact with the bead. On continuing the fitting motion, on the one hand the entire free end of the flap will be pivoted radially outwards, and on the other hand the flaps will, however, also be intrinsically bent upwards, and their thinner lateral edge areas will likewise be displaced outwards in relation to the centre of the flap.

The flaps can be arranged in different ways along the anti-tamper strip. In particular, the distance between the adjacently arranged flaps can be selected in different ways. With a preferred embodiments the flaps are arranged tightly adjacently along the anti-tamper strip. The lateral edges of the adjacently arranged flaps are, with that, connected together by a flexible bridge piece of material in the form of a linkage. In this way, a longitudinal flap strip comprising a plurality of flaps will arise. The flaps will thus hold each other mutually in-position so that they can no longer be pivoted with such ease. This is advantageous if the closure cap is cast in a form in which the flaps are pointed downwards, away from the cap base. This position of the flaps is preferred when casting the closure cap, since the cap can be more easily removed from the mold after casting. The flaps must, however, subsequently be pivoted from their downward pointing position inwards. This ensues preferably in a separate working step prior to fitting of the closure cap. The flaps have, however, the basic tendency to return to their original cast position. One possibility of avoiding this is now to connect adjacently arranged flaps together as previously described. The flaps will then mutually hold each other at their inner position, directed towards the cap base.

If individual flaps are used, arranged at a distance from one another, these can be fixed in another way in their position directed towards the cap base, for example by means of a brief application of heat after the flaps have been pivoted into this position. A possible alternative is to pivot the flaps inwards by means of the container mouth directly on fitting of the closure cap on the container mouth. A specially designed container mouth is as a rule required for this, however.

Preferably, a circumferential anti-tamper ring is used as an anti-tamper strip, wherein the flaps are arranged to be distributed uniformly around the circumference.

BRIEF DESCRIPTION OF THE DRAWINGS

Examples and embodiments of the invention are more closely described in the following, illustrated by the drawings: namely, FIG. 1 a cross section of a closure cap according to the invention along the plane B—B in FIG. 2, FIG. 2 the anti-tamper strip of the closure cap shown in FIG. 1 from above, along the plane A—A of FIG. 1, FIG. 3 a cross section of the closure cap already shown in FIG. 1, with flaps directed downwards, FIG. 4 a cross section of a further closure cap with a plurality of flaps arranged at a distance from one another, FIG. 5 a closure cap in position on a container mouth.

DESCRIPTION OF THE PREFERRED EMBODIMENTS(S)

Figure 1:
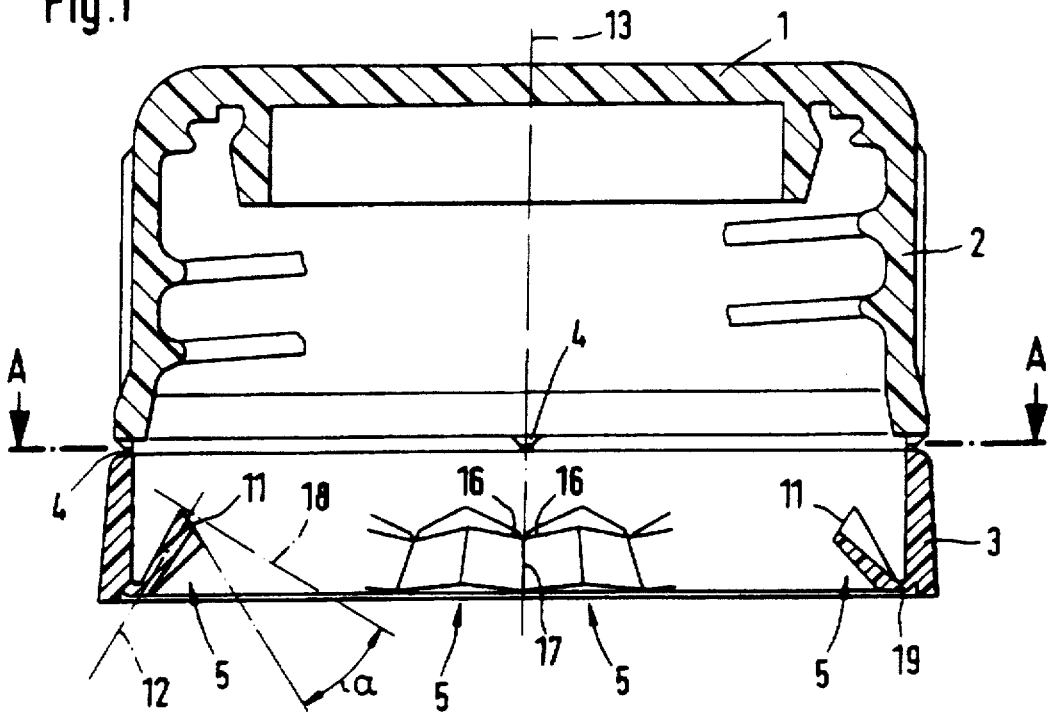
Figure 2:
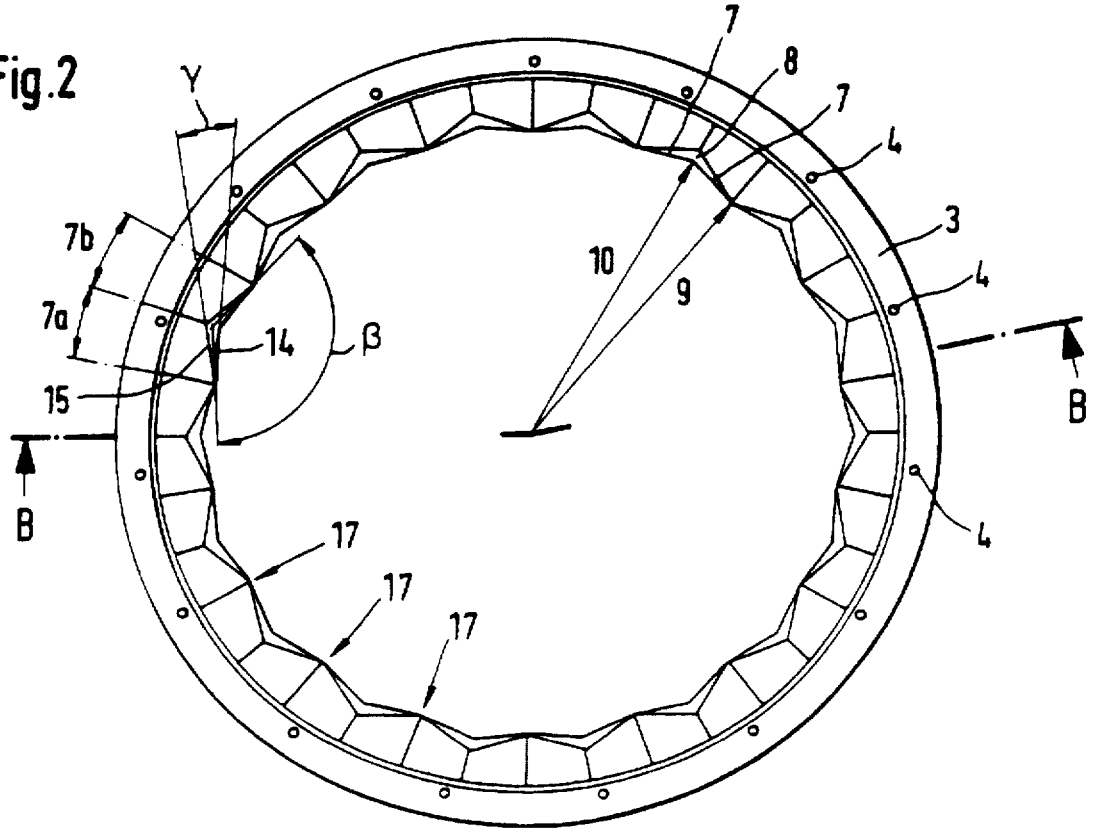

The closure cap shown in FIG. 1 possesses a cap base 1, an abutting cap wall 2 and a tearable anti-tamper strip 3 arranged on the lower edge of said cap wall. The anti-tamper strip 3 is integrally connected with the cap wall 2 by means of nominal rupture bridge pieces 4. With the anti-tamper strip 3 shown here, a circumferential anti-tamper ring is concerned. In FIG. 2, this is shown from above in a horizontal section seen along the plane A—A shown in FIG. 1. From the inside surface of the anti-tamper ring 3, a plurality of flaps 5 extend radially inwards. The flaps 5 shown here are arranged to be tightly adjacent and are connected together by flexible material bridges 17 into a circumferential inner flap strip. These connecting bridge pieces can, however, be dispensed with so that the adjacently arranged flaps are independent of one another.

The flaps 5 are only connected at one end with the anti-tamper ring 3 by means of a linkage connection 19. This linkage connection 19 enables the free end of the flaps 5 to pivot in the radial direction so that especially on initial fitting of the closure cap this can deflect radially outwards when said free end slides over the bead on the container mouth. The linkage connection 19 is preferably arranged on the lower edge of the anti-tamper ring. It would be also basically conceivable, however, for the anti-tamper ring to extend downwards below the connection point of the linkage connection 19.

In the left half of FIG. 1, a section through the centre of a flap is shown, whereas the right half of FIG. 1 shows a section through the edge area of a flap. This can also be seen from the sectional plane B—B in FIG. 2. The lateral edge areas 7 of the flaps 5 directed towards the cap base 1 are directed inwards in such a way that they possess in their edge area a lesser distance 9 in relation to the cap axis than the flap centre 8. At the same time, the lateral edge areas 7 are folded symmetrically inwards towards the flap centre 8. The flaps 5 are thus curved in the area of the flap centre 8, by which means the resistance to pressure of the flaps will be considerably enhanced. Transmission by the flap centre of the greatest portion of the forces acting on the flaps will thus be achieved. The mechanical stability of the flaps will be further increased as a result.

The thinner edge areas 7 impart to the flaps an inherent spring effect which additionally supports the spring effect of the linkage connection 19. On fitting the closure cap onto the container mouth for the first time, first of all the lateral edge area 7 of the flaps will make contact on the bead of the container mouth. If the screwing motion is continued, the individual flaps 5 will thus pivot about their linkage connection 19 radially outwards. Additionally, however, the flaps 5 have an inherent spring effect, and the edge areas 7 of the flaps making contact with the bead on the container mouth will be pressed radially outwards in relation to the flap centres 8.

The individual flaps each comprise two flap halves 7*a*, 7*b*, each with an inner demarcation surface 14 and an inner demarcation surface 15. The flap halves meet in the centre at an angle $\beta$ of approximately 120°. The demarcation areas 14, 15 of the flap halves diverge at an angle $\gamma$ of approximately 15° in relation to the flap centre, so that the tomgue centre 8 is thicker than the lateral edge area 7 of the flaps.

Figure 5:
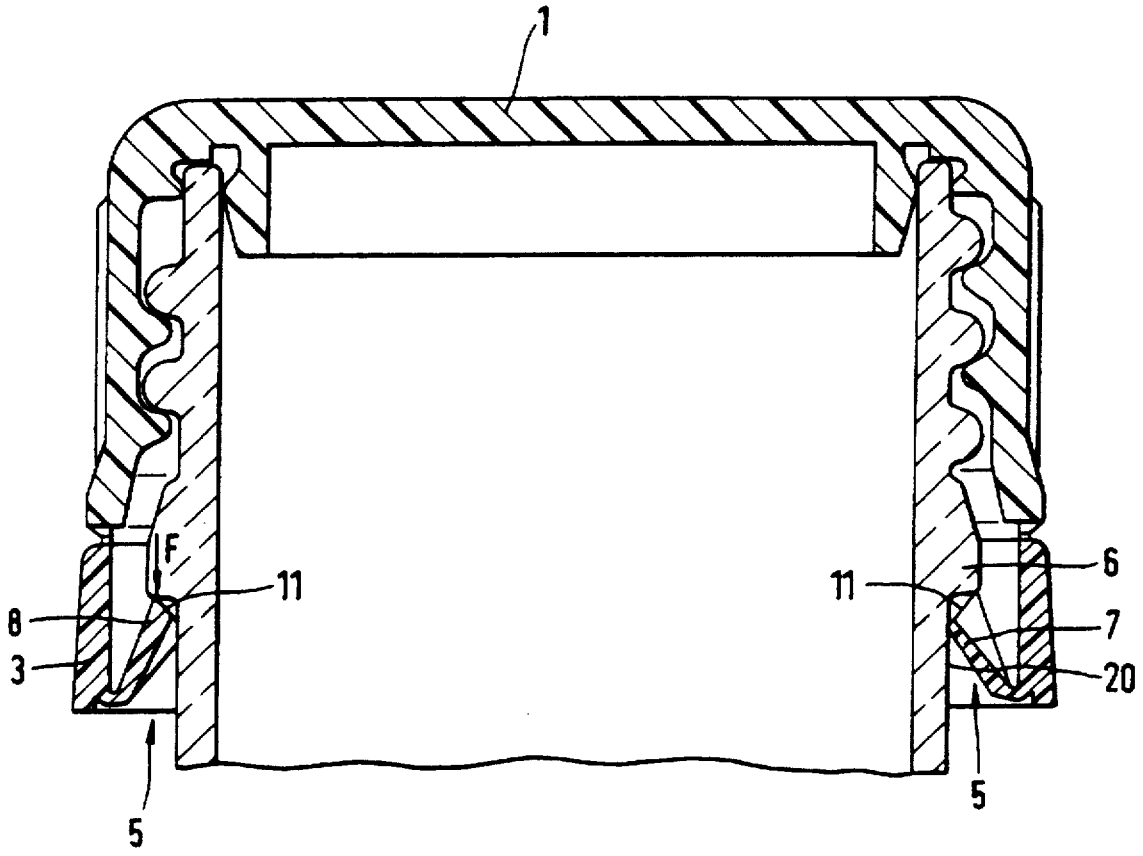

The facing surfaces 11 directed towards the cap base are inclined at an angle $\alpha$ more steeply in relation to the cap axis 13 than a normal plane 18 running vertically to the neutral mean centre-line 12 of each respective flap. Thus, the height difference between the radially more outward lying flap centre 8 and the inwardly directed edge areas 7 of the flaps will be additionally enhanced. Due to this height difference, the flap centre 8 will make contact with the underside of the bead 6 (FIG. 5). Conversely, the lateral edge areas 7 of the flaps 5 make contact beneath the bead 6 with the outside surface of the container neck 20.

Figure 3:
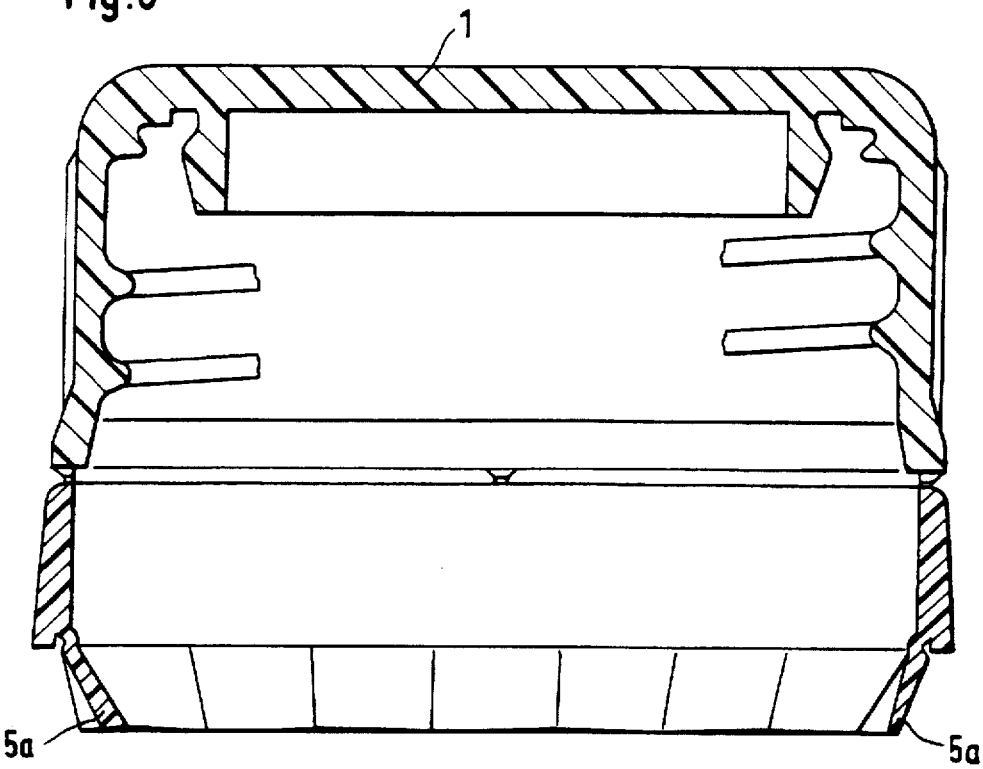

FIG. 3 shows the closure cap already shown in FIG. 1 in a position with flaps 5*a* pointing downwards, away from the cap. The flaps are preferably cast in this position and subsequently folded into their inner position directed towards the cap base. In this respect, it is advantageous if the flaps, as this example shows, are arranged to be tightly adjacent. After having been pivoted inwards, the tightly adjacently arranged flaps can mutually hold each other in this position. If the flaps were to be arranged at a greater distance from one another, they would tend to return into their original downward pointing position (as created by casting). This can be prevented in a particularly effective way if the lateral edges of the adjacently arranged flaps are connected by flexible bridging pieces 17 of material (FIG. 1) in the form of a linkage.

Figure 4:
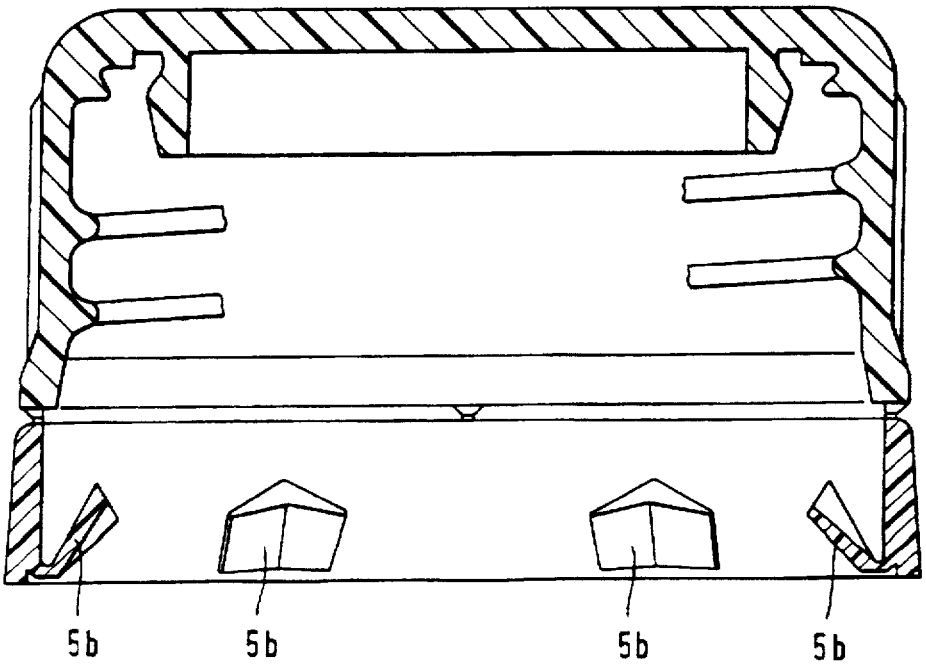

FIG. 4 shows the cross section of an alternative embodiment wherein the individual flaps are arranged to be distributed equidistantly along the circumference of the anti-tamper strip. The same basic function and effect as shown with the mutually connected flaps in FIG. 1 basically applies to these flaps. The flaps 5*b* can either be cast in the position shown or in the downward pointing position similar to that shown in FIG. 3, said flaps then first of all having to be folded inwards prior to fitting of the closure cap on the container mouth. With the embodiment shown here, only six flaps are arranged along the circumference of the anti-tamper strip. Preferably, however, a greater number of flaps are used that are correspondingly more tightly distributed, in other words with smaller spacing, along the circumference.

Inasmuch as the invention is subject to modifications and variations, the foregoing description and accompanying drawings should not be regarded as limiting the invention, which is defined by the following claims and various combinations thereof:

We claim:

1. A closure cap for closure of a container mouth, said closure cap comprising:

a cap base and an abutting cap wall, an anti-tamper strip being arranged on the lower edge of said cap wall, and a plurality of flaps being arranged on the inside surface of the anti-tamper strip to protrude radially inwards having facing surfaces at a distal end, lateral portions of the facing surfaces defining lateral edge areas, a center portion of each of the facing surfaces defining flap centers, said flaps pointing upwards towards the cap base in order to engage beneath a bead on the container mouth when the closure cap is at a predetermined position on the container mouth, characterized in that the lateral edge areas of the flaps directed towards the cap base are directed inwards in such a way that, at one position at least, the lateral edge areas being more closely located to the cap axis than the flap centres.

2. The closure cap according to claim 1, characterized in that the flap centres are thicker than the lateral edge areas of the flaps.

3. The closure cap according to claim 1, characterized in that, when the closure cap is at the position on the container mouth, the facing surfaces directed towards the bead of the container mouth, of the flaps are more steeply inclined towards the cap axis than a normal plane running perpendicularly to a neutral mean centre-line of each respective flap.

4. The closure cap according to claim 1, characterized in that each of the flaps having a center includes a left flap half and a right flap half disposed in contact in the centre at a predetermined angle.

5. The closure cap according to claim 4, characterized in that the flap halves are arranged at an obtuse angle $\beta$ in relation to one another, preferably an angle of 120°.

6. The closure cap according to claim 4, characterized in that each flap half has inner and outer demarcation surfaces which diverge at an angle $\gamma$ approximately ranging from 5° to 30° so that the flap centres are each thicker than the lateral edge areas.

7. The closure cap according to claim 1, characterized in that the flaps are arranged to be tightly adjacent along the anti-tamper strip and the lateral edge areas of adjacently arranged flaps are connected by a flexible bridge piece of material in the form of a linkage.

8. The closure cap according to claim 1, characterized in that the anti-tamper strip is a circumferential anti-tamper ring and the flaps are arranged to be distributed uniformly around the circumference of said anti-tamper ring.

* * * * *

UNITED STATES PATENT AND TRADEMARK OFFICE

CERTIFICATE OF CORRECTION

PATENT NO. : 5,775,527

DATED : July 7, 1998

INVENTOR(S) : Bösl et al.

It is certified that error appears in the above-indentified patent and that said Letters Patent is hereby corrected as shown below:

On the title page, item [30]delete "395/95" and insert --395/95-3 -- therefor.

On the title page, Abstract, 1.14,delete "preferaly" and insert --preferably -- therefor.

Column 2, Line 11, insert --SUMMARY OF THE INVENTION-- before "According to the invention,".

Column 2, Line 14 delete "SUMMARY OF THE INVENTION".

Column 3, Line 22, delete "With a preferred embodiments" and insert --With a preferred embodiment-- therefor.

Column 4, Line 3, delete "EMBODIMENTS(S)" and insert --EMBODIMENT(S)-- therefor.

Column 4, Line 64, delete "so that the tomgue" and insert --so that the tongue-- therefor.

Column 6, line 21, delete "the facing surfaces directed" and insert -- the facing surfaces, directed-- therefor.

Signed and Sealed this

Twenty-fourth Day of August, 1999

*Attest:*

Q. TODD DICKINSON

*Attesting Officer*

*Acting Commissioner of Patents and Trademarks*